US006805604B2

(12) United States Patent
Brumagin et al.

(10) Patent No.: US 6,805,604 B2
(45) Date of Patent: Oct. 19, 2004

(54) TOY DRIVING SIMULATOR

(75) Inventors: James G. Brumagin, Angola, NY (US); Peter M. Harris, Buffalo, NY (US); John T. Smokowski, West Seneca, NY (US)

(73) Assignee: Mattel, Inc., El Segundo, CA (US)

( * ) Notice: Subject to any disclaimer, the term of this patent is extended or adjusted under 35 U.S.C. 154(b) by 52 days.

(21) Appl. No.: 09/985,465

(22) Filed: Nov. 2, 2001

(65) Prior Publication Data

US 2003/0087699 A1 May 8, 2003

(51) Int. Cl.[7] ..... A63H 27/127; A63H 17/00

(52) U.S. Cl. ..... 446/37; 446/7; 434/63; 273/442

(58) Field of Search ..... 446/7, 37; 434/62, 434/63, 70; 463/6, 37, 38; 273/442

(56) References Cited

U.S. PATENT DOCUMENTS

| | | | | |
|---|---|---|---|---|
| 2,108,726 | A | | 2/1938 | Rocuskie |
| 2,254,967 | A | | 9/1941 | Larkins, Jr. |
| 2,260,432 | A | | 10/1941 | Brown |
| 2,309,216 | A | | 1/1943 | Rocuskie |
| 2,454,693 | A | | 11/1948 | Foster |
| 2,742,714 | A | | 4/1956 | Allgaier |
| 2,908,087 | A | | 10/1959 | Weinreich et al. |
| 3,171,215 | A | * | 3/1965 | Glass et al. |
| 3,568,332 | A | * | 3/1971 | Koci et al. |
| 3,594,921 | A | | 7/1971 | Quicker, Jr. |
| 3,918,176 | A | | 11/1975 | Abernethy, III et al. |
| 4,174,833 | A | * | 11/1979 | Hennig et al. |
| 4,208,831 | A | | 6/1980 | Strauss |
| 4,221,072 | A | | 9/1980 | Monin |
| 4,265,047 | A | | 5/1981 | Meyer et al. |
| 4,270,306 | A | | 6/1981 | Klawitter |
| 4,326,721 | A | | 4/1982 | Minami et al. |
| D274,447 | S | | 6/1984 | Appel et al. |
| 4,474,372 | A | * | 10/1984 | Karasawa ..... 273/1 GA |
| 4,550,503 | A | | 11/1985 | Klawitter |
| 4,573,936 | A | * | 3/1986 | Wolf ..... 446/7 |
| 4,575,070 | A | | 3/1986 | Kinberg et al. |
| 4,594,072 | A | | 6/1986 | Cowell |
| 4,793,610 | A | * | 12/1988 | Moomaw et al. ..... 273/1 GC |
| 4,932,913 | A | | 6/1990 | Raviv et al. |
| 5,106,102 | A | * | 4/1992 | Mitsumoto ..... 273/442 |
| D343,423 | S | | 1/1994 | Shiraishi |
| 5,855,483 | A | | 1/1999 | Collins et al. |
| 5,967,898 | A | | 10/1999 | Takasaka et al. |
| 6,200,138 | B1 | | 3/2001 | Ando et al. |
| 6,364,771 | B1 | * | 4/2002 | Lee ..... 463/46 |
| 6,435,875 | B1 | | 8/2002 | Karussi |
| 6,461,238 | B1 | | 10/2002 | Rehkemper et al. |

FOREIGN PATENT DOCUMENTS

| | | | |
|---|---|---|---|
| GB | 2 206 054 A | * | 12/1988 |
| GB | 2209023 A | | 4/1989 |

* cited by examiner

*Primary Examiner*—Derris H. Banks
*Assistant Examiner*—Ali Abdelwahed
(74) *Attorney, Agent, or Firm*—Cooley Godward LLP

(57) ABSTRACT

A toy driving mechanism includes a housing, a display element coupled to the housing, and a controller mounted on the housing and coupled to the display element.

33 Claims, 12 Drawing Sheets

TOY DRIVING SIMULATOR

BACKGROUND OF THE INVENTION

This invention relates to a toy driving simulator, and in particular, to a toy driving simulator and a method of using the toy driving simulator.

Conventional toy driving simulators include a toy vehicle that a user controls along a road or pathway. Some toy driving simulators utilize a representation of a continuous road along which a user tries to align the toy vehicle. Conventional toy driving simulators do not enable the user to simultaneously control a toy vehicle and the simulated road or path. A need exists for a toy driving simulator that enables a user to simultaneously move a toy vehicle and boundary structures that define a road or path.

SUMMARY OF THE INVENTION

A toy driving mechanism includes a housing, a display element coupled to the housing, and a controller mounted on the housing and coupled to the display element. In one embodiment, the display element includes a representation of a toy vehicle. In an alternative embodiment, the toy driving mechanism includes multiple display elements coupled to the housing and to the controller. In an alternative embodiment, the toy driving mechanism includes two controllers mounted on the housing and coupled to a toy vehicle. In an alternative embodiment, the toy driving mechanism includes an output generating circuit that generates audio and visual outputs in response to user inputs.

DETAILED DESCRIPTION OF THE INVENTION

A toy driving mechanism includes a housing, a display element coupled to the housing, and a controller mounted on the housing and coupled to the display element. In one embodiment, the display element includes a representation of a toy vehicle. In an alternative embodiment, the toy driving mechanism includes multiple display elements coupled to the housing and to the controller. In an alternative embodiment, the toy driving mechanism includes two controllers mounted on the housing and coupled to a toy vehicle. In an alternative embodiment, the toy driving mechanism includes an output generating circuit that generates audio and visual outputs in response to user inputs.

Figure 1:
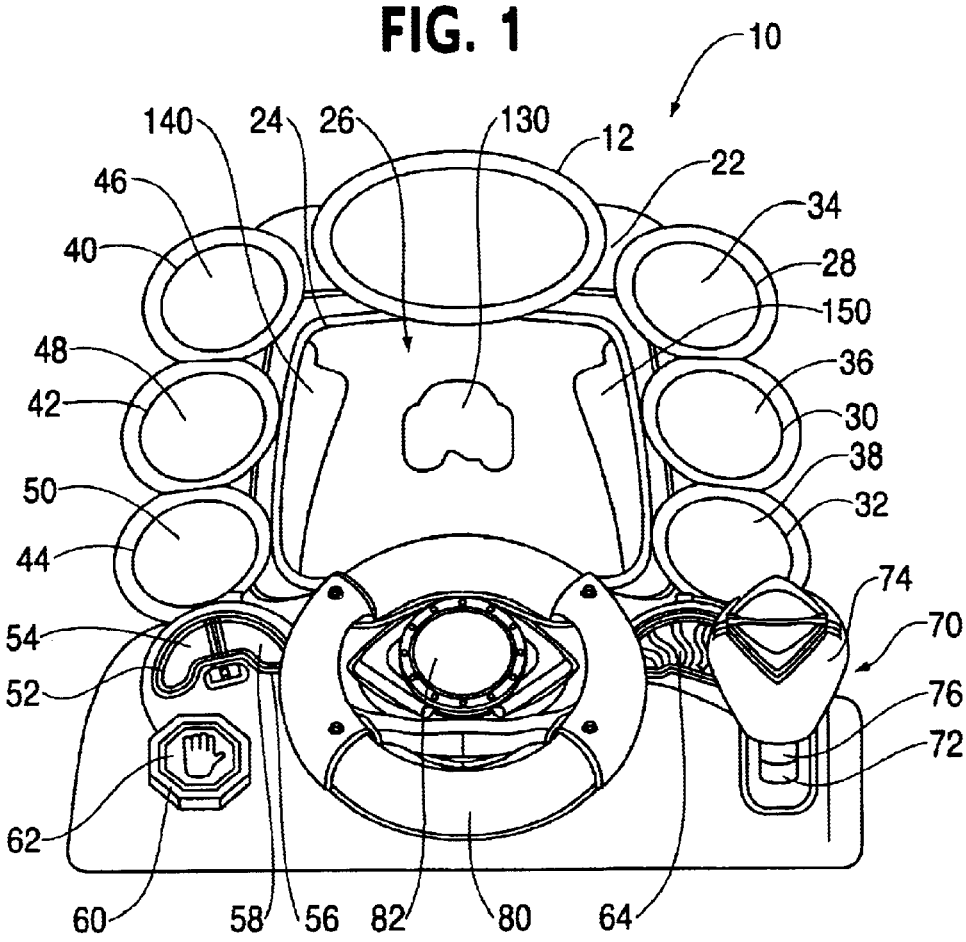
FIG. 1 illustrates an embodiment of a toy driving mechanism in accordance with the present invention.
Figure 2:
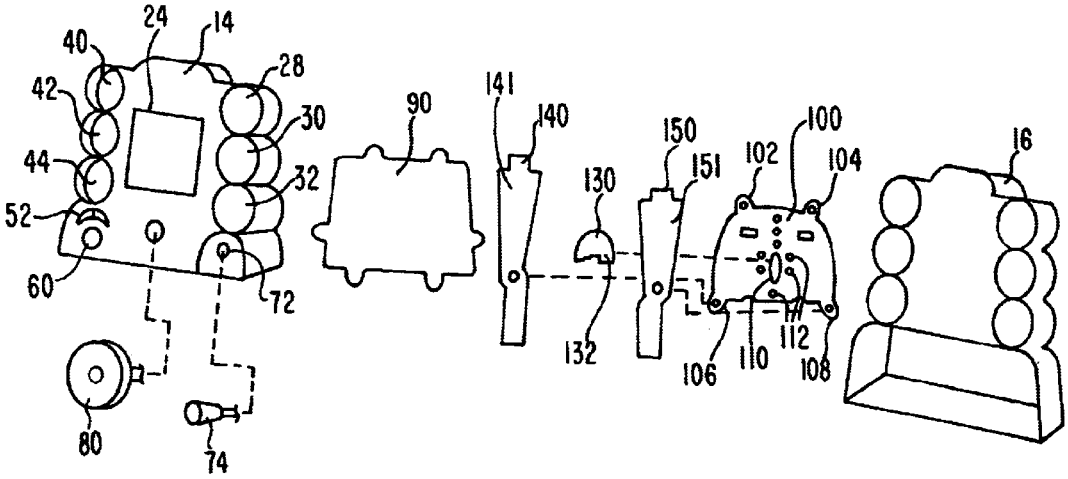
FIG. 2 illustrates an exploded perspective view of some of the components of the toy driving mechanism of FIG. 1.

An embodiment of a toy driving mechanism in accordance with the present invention is illustrated in FIGS. 1 and 2. The toy driving mechanism 10 includes a housing 12. In the illustrated embodiment, the housing 12 includes a front portion 14 and a rear portion 16. The front portion 14 and rear portion 16 are coupled together by any conventional fastening mechanism. In an alternative embodiment, the front and rear portions may be formed integrally. Each of the front portion 14 and the rear portion 16 includes several walls that define an interior region therebetween.

In the illustrated embodiment, the housing 12 includes a front surface 22 that has several openings. The front surface 22 includes a display opening 24 that defines a display area 26.

The front surface 22 includes several openings 28, 30, 32, 40, 42, and 44. The driving mechanism 10 includes several covers 34, 36, 38, 46, 48, and 50 that are aligned with the openings 28, 30, 32, 40, 42, and 44, respectively. In the illustrated embodiment, each cover is a colored, plastic cover behind which a light (not shown) is placed. As a particular light is illuminated, the corresponding cover appears to light up, similar to a traffic light. The covers may include patterns or other indicia thereon.

In the illustrated embodiment, the housing 12 includes apertures 52 and 56 in which a level selection button 54 and a game selection button 58 are operably disposed. The housing 12 also includes an aperture 60 in which a stop button 62 is operably disposed. The functions of the buttons 54, 58 and 62 will be described in more detail below. The housing 12 also includes a speaker grill 64 with openings through which audible outputs, such as speech and sound effects, from an output generating circuit are heard.

Figure 3:
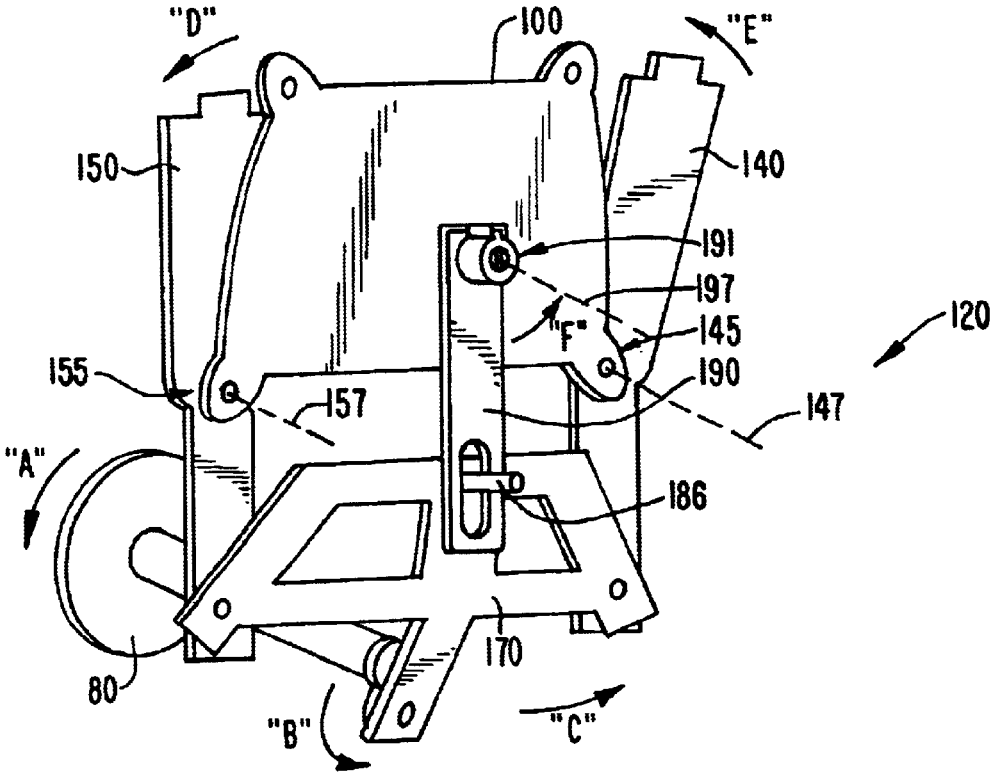
FIG. 3 illustrates an assembled perspective view of the steering mechanism components of the toy driving mechanism of FIG. 1.
Figure 4:
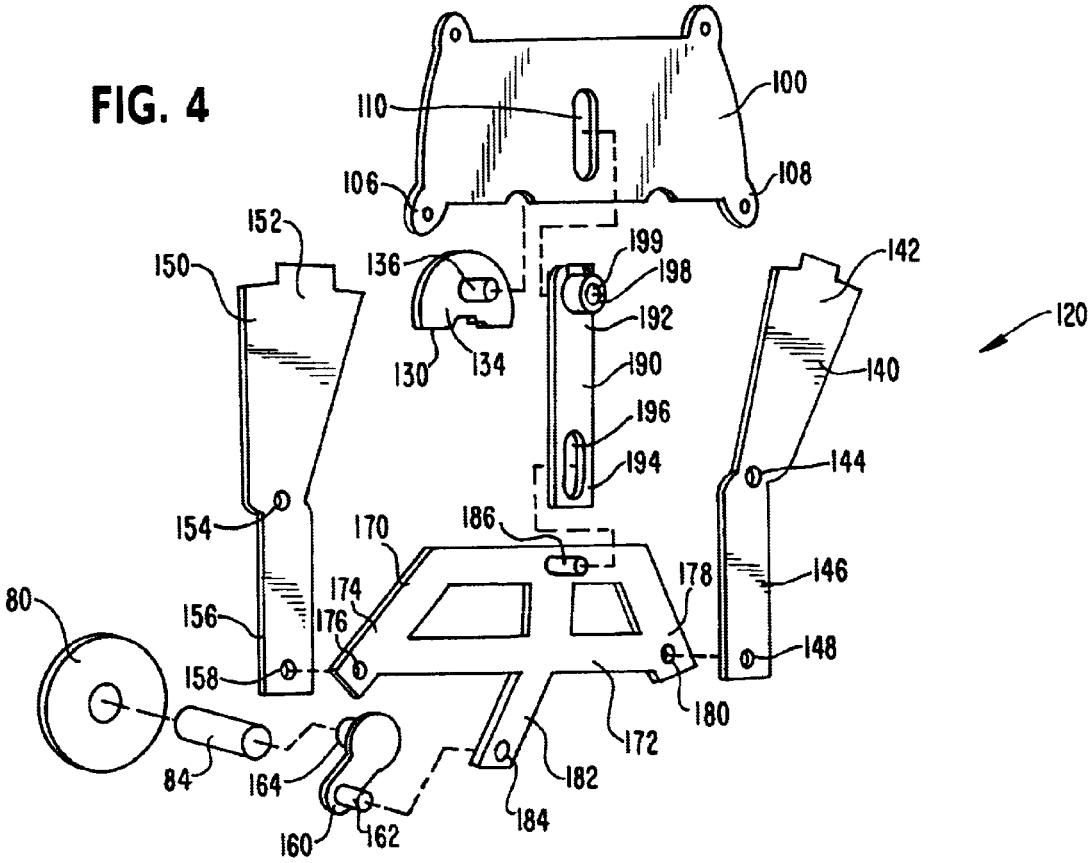
FIG. 4 illustrates an exploded perspective view of the steering mechanism components of FIG. 3.

In the illustrated embodiment, the toy driving mechanism 10 includes a controller or actuator 80 that is rotatably mounted on the housing 12. In one embodiment, the controller 80 resembles a steering wheel of a vehicle. The steering wheel 80 includes a horn 82 that is connected to a switch (not shown) that is part of the output generating circuit. The steering wheel 80 is coupled to a steering mechanism, which is illustrated in FIGS. 3 and 4.

Figure 5:
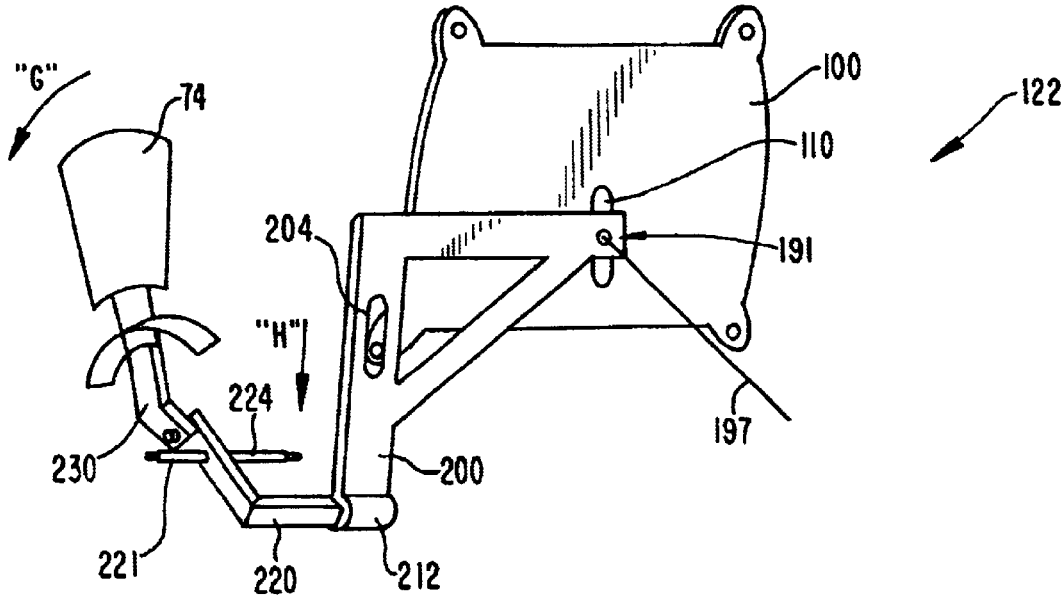
FIG. 5 illustrates an assembled perspective view of the shifting mechanism components of the toy driving mechanism of FIG. 1.
Figure 6:
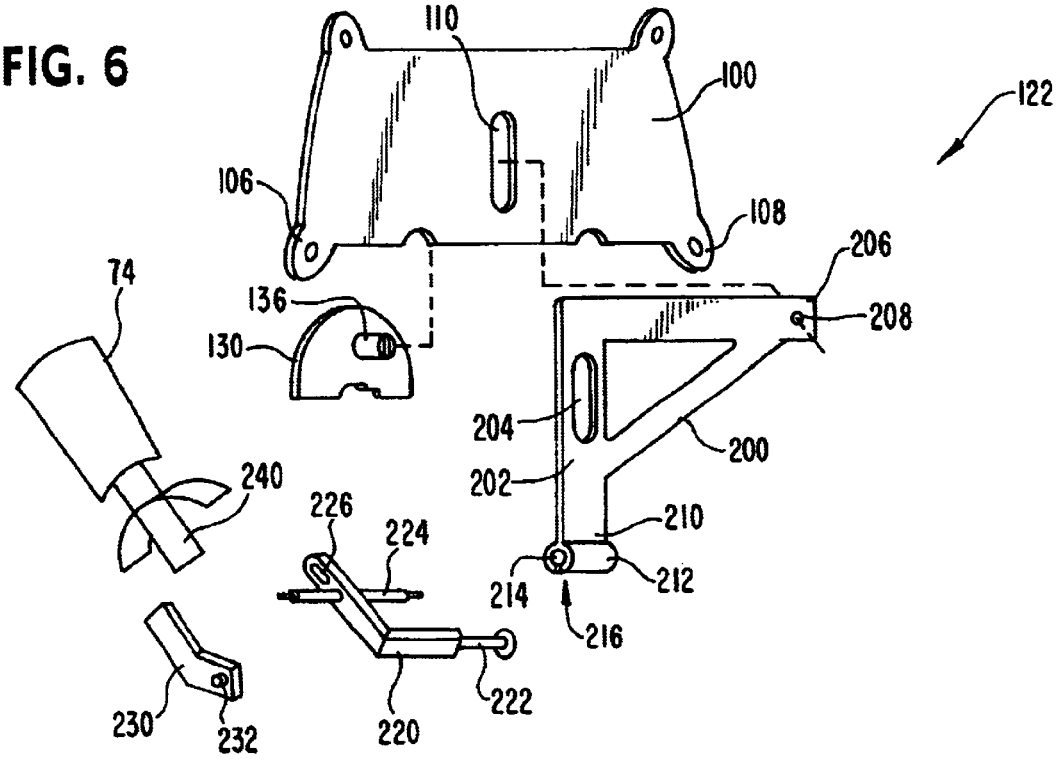
FIG. 6 illustrates an exploded perspective view of the shifting mechanism components of FIG. 5.

As illustrated in FIG. 1, the toy driving mechanism 10 also includes a controller or actuator 70 that is slidably coupled to the housing 12. In one embodiment, the controller 70 includes a shifter knob or shift lever 74. The housing 12 includes a slot 72 through which a shaft 76 coupled to the lever 74 passes. The controller 70 is coupled to a shifting mechanism, which is illustrated in FIGS. 5 and 6.

In the illustrated embodiment, the toy driving mechanism 10 includes several display elements. The display elements may be referred to alternatively as display portions or representations. The toy driving mechanism 10 includes a first display element or portion 130 that has a contour that resembles a vehicle. The toy driving mechanism 10 also includes display elements or portions 140 and 150 located proximate to the sides of the display area 26. Each of the display elements 130, 140 and 150 is coupled to the steering wheel 80 for movement by the user. The display element 130 is also coupled to the shifting knob 74, as discussed in greater detail below.

An embodiment of several components of a toy driving mechanism is illustrated in FIG. 2. The toy driving mechanism 10 includes a screen 90 that is coupled to an inner surface of the front portion 14 of the housing 12. The screen 90 is a transparent, plastic member that is secured to the front portion 14 of the housing 12 using conventional fasteners.

In the illustrated embodiment, the toy driving mechanism 10 includes a medium 100 that is coupled to the housing. The medium 100 is a plastic display plate or portion 100 that is coupled to the front portion 14 of the housing 12. The display plate 100 can include an image displayed thereon. For example, the image can be a representation of a road, pathway, course, or other driving surface.

The display plate 100 includes several extensions 102, 104, 106, and 108 with openings through which fasteners (not shown) may be inserted. The display plate 100 includes a slot 110 therethrough, the function of which is described in greater detail below.

The display plate 100 also includes several openings 112 through which lights may be inserted. These lights are referred to as roadway lights and are illuminated in either a top to bottom or a bottom to top sequence, thereby creating the illusion that the toy vehicle is traveling in a forward or a reverse direction. The display plate 100 also includes two openings 111 through which lights may be inserted. These lights are referred to as obstruction or barrier lights and are illuminated as discussed in greater detail below.

In the illustrated embodiment, the display element 130 includes a front surface 132. Indicia representative of a vehicle may be located on the front surface 132. The display element 130 includes a rear surface 134 and a connection member extending from the rear surface 136 (see FIG. 4). In an alternative embodiment, the display element 130 can have any shape or configuration.

The display elements 140 and 150 include front surfaces 141 and 151, respectively. Indicia relating to driving are included on the front surfaces 141 and 151. For example, a sticker or picture of fans in a grandstand can be included on the front surfaces 141 and 151.

An embodiment of a drive or steering mechanism is illustrated in FIGS. 3 and 4. FIGS. 3 and 4 are rear perspective views of some of the internal components of the toy driving mechanism. Rotation of the steering wheel 80 causes movement of the display elements 130, 140 and 150 via the steering mechanism 120.

In the illustrated embodiment, display element 140 includes ends 142 and 146 and an opening 144 located proximate to the middle of the display element 140 as shown in FIG. 4. An extension 148 extends from the rear surface of the display element 140 proximate to end 146. Similarly, display element 150 includes ends 152 and 156 and an opening 154 located proximate to the middle of the display element 150. An extension 158 extends from the rear surface of the display element 150 proximate to end 156.

In the illustrated embodiment, the steering mechanism 120 includes a coupler 160. The coupler 160 includes a receiving post 164 disposed on its front surface and an extension 162 disposed on its rear surface. The steering mechanism 120 includes a shaft 84 coupled to the steering wheel 80. The shaft 84 is operably coupled to the receiving post 164. Rotation of the steering wheel 80 clockwise or along the direction of arrow "A" causes rotation of the coupler 160 along the direction of arrow "B".

The steering mechanism 120 includes a drive member 170. In this embodiment, the drive member 170 includes a planar portion 172 and an angled portion 182 extending from a side of the planar portion 172. The planar portion 172 includes a first end 174 and a second end 178. Openings 176 and 180 are located proximate to ends 174 and 178, respectively. The angled portion 182 includes an opening 184.

The extension 162 of the coupler 160 operatively engages the angled portion 182 of the drive member 170. As the coupler 160 rotates along the direction of arrow "B", the drive member 170 moves in the direction of arrow "C."

The drive element 170 is operatively coupled to the display elements 140 and 150. The end 156 of the display element 150 is pivotally coupled to the drive member 170. A fastener (not shown) is inserted into the opening 158 on the display element 150 and the opening 176 on the drive member 170. Similarly, the end 146 of the display element 140 is pivotally coupled to the drive member 170. A fastener (not shown) is inserted into the opening 148 on the display element 140 and the opening 180 on the drive member 170.

The display member 140 is pivotally coupled to the extension 108 of the display plate 100 via a fastener (not shown) inserted through opening 144. Similarly, the display member 150 is pivotally coupled to the extension 106 of the display plate 100 via a fastener inserted through opening 154.

As the drive member 170 moves in the direction along the arrow "C", the connections between the display elements 140 and 150 and the drive member 170 translate in the same direction. Thus, the display element 140 rotates about a pivot point 145 and axis 147 along the direction of arrow "E." Similarly, the display element 150 rotates about a pivot point 155 and axis 157 along the direction of arrow "D". In the illustrated embodiment, axis 147 is substantially parallel to axis 157 (see FIG. 3).

In the illustrated embodiment, the steering mechanism 120 includes a link 190. The link 190 has a first end 192 and a second end 194. The link 190 includes a slot 196 proximate to end 194. The link 190 also includes a collar 198 proximate to end 192. The collar 198 includes an opening 199 formed therethrough.

In the illustrated embodiment, the post 136 on the display element 130 is inserted through the slot 110 of the plate 100 and is coupled to link 190 via collar 198. The extension 186 on the drive member 170 is inserted into slot 196 of the link 190. As the drive member 170 moves in the direction of arrow "C", the link 190 rotates in the direction of arrow "F" about a pivot point 191 and axis 197. Since the display element 130 is operatively coupled to the link 190, the display element 130 rotates about pivot point 191 in the same direction as the other display elements 140 and 150. In the illustrated embodiment, axis 197 is substantially parallel to axes 147 and 157.

When a user rotates the steering wheel 80 in a counterclockwise direction, each of the components of the steering mechanism 120 is moved in directions opposite to those discussed above.

An embodiment of a shifting mechanism is illustrated in FIGS. 5 and 6. FIGS. 5 and 6 are rear perspective views of some of the internal components of the toy driving mechanism. For simplicity only, the steering mechanism components discussed relative to FIGS. 3 and 4 are not illustrated in FIGS. 5 and 6. Shifting mechanism 122 causes movement of the display element 130 in response to movement of the shifter knob 74.

In the illustrated embodiment, the shifting mechanism 122 includes a lifting link 200. The lifting link 200 includes a body 202 having a slot 204 and ends 206 and 210. The body 202 includes an opening 208 proximate to end 206. The body 202 also includes a connector 212 proximate to end 210. The connector 212 defines a channel 214 and an opening 216 in communication with the channel 214.

In the illustrated embodiment, the post 136 on the display element 130 is inserted into the opening 208 on the lifting link. As the lifting link 200 moves, the display element 130 moves. A fastener (not shown) is inserted through the slot 204 in the lifting link 200 and through the opening in the extension 106 of the display plate 100. Thus, the lifting link 200 can move linearly up and down relative to the housing 12.

As illustrated in FIG. 6, the shifting mechanism 122 includes a link 220 that has a shaft 222 connected to one end. The link 220 also includes an axle 224 and a slot 226 proximate to one end. The shifting mechanism 122 also includes link 230 with a post 232 disposed thereon. The post 232 engages the slot 226. The shifter knob 74 is mounted on a shaft 240 that is coupled to the link 230.

Referring to FIG. 5, as the user moves the shifter knob 74 downwardly along the direction of arrow "G", the link 220 rotates about pivot point 221 and axle 224, which is coupled to the housing 12. As the link 220 rotates, the lifting link 200 moves downwardly along the direction of arrow "H". Since the display element 130 is connected to the lifting link 200, the display element 130 moves in the same direction as the lifting link 200. In this arrangement, the display element 130, pivot point 191, and axis 197 move along the direction of arrow "H."

When a user moves the shifting knob 74 upwardly, each of the components of the shifting mechanism 122 is moved in a direction opposite to those discussed above.

Several configurations of an embodiment of a toy driving mechanism according to the principles of the invention are illustrated in FIGS. 7–11. The toy driving mechanism 10 includes display elements 130, 140, and 150. As illustrated, display element 130 resembles a vehicle and display elements 140 and 150 resemble boundaries of a road or grandstands for a race or other structures.

Figure 7:
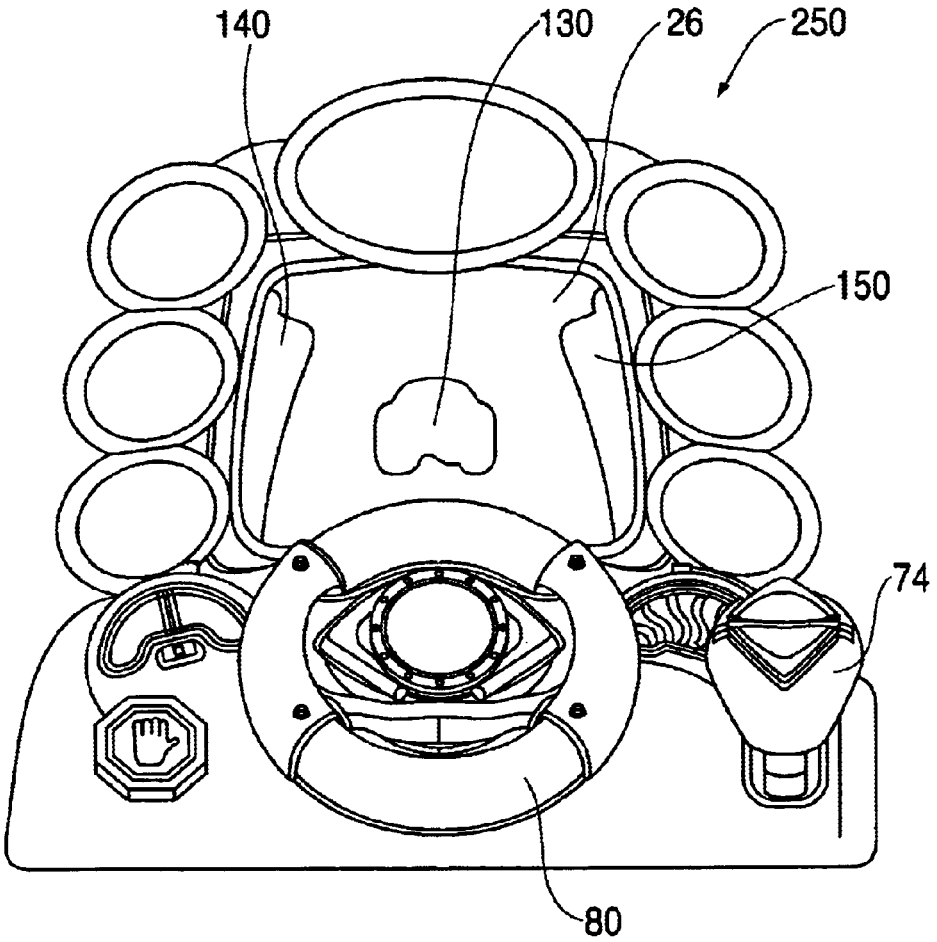
FIG. 7 illustrates the toy vehicle and boundary representations in a first configuration in accordance with the present invention.

In FIG. 7, the display elements 130, 140, and 150 are illustrated relative to the housing 12 in a first configuration 250. In this configuration, the display element 130 is disposed proximate to the center of the display area 26. Also, the display elements 140 and 150 are located on opposite sides of the display area 26.

The steering wheel 80 and the shifter knob 74 are disposed in base or resting positions. In the illustrated embodiment, the steering wheel 80 and the shifter knob 74 are biased by biasing mechanisms, such as springs, to their positions illustrated in FIG. 7.

Figure 8:
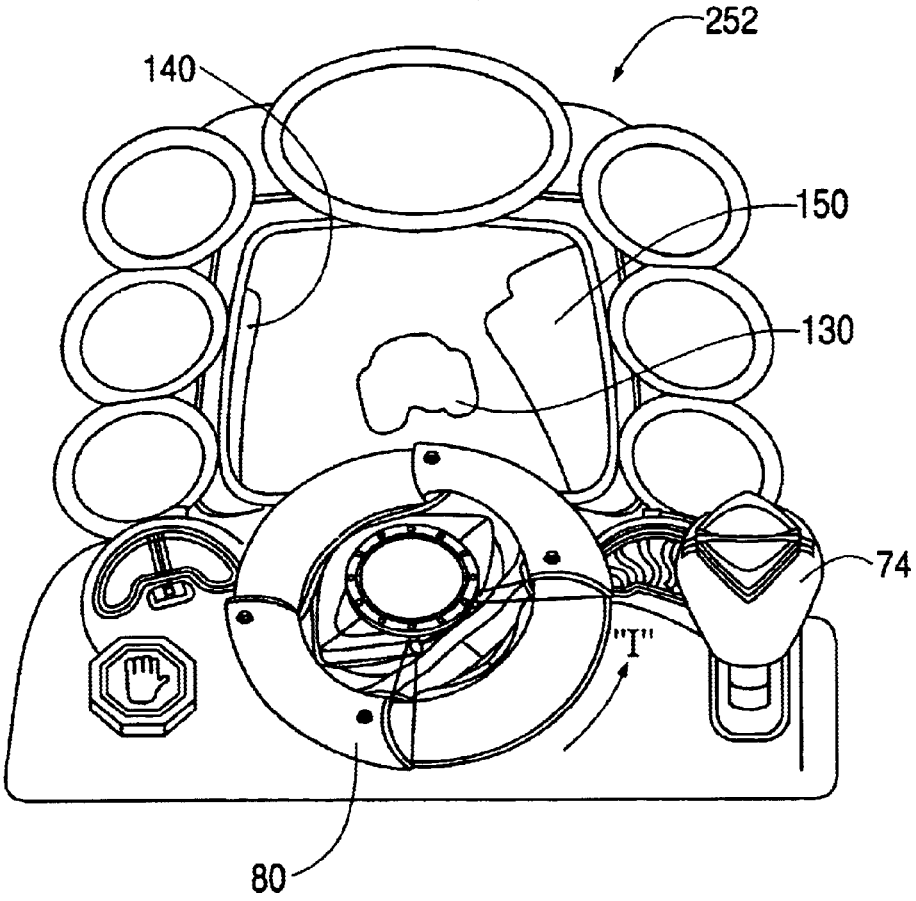
FIG. 8 illustrates the toy vehicle and boundary representations in a second configuration in accordance with the present invention.

In FIG. 8, the display elements 130, 140, and 150 are illustrated in a second configuration 252. In this configuration, the steering wheel 80 is rotated counterclockwise in the direction of arrow "I". As the steering wheel 80 is rotated, the display element 130 rotates to the left, thereby creating the appearance that the vehicle is turning to the left.

At the same time, display element 140 pivots to a position in which most of the display element 140 is not visible. Display element 150 also pivots to the left and the amount of the display element 150 visible in the display area increases. The movement of display elements 140 and 150 creates the appearance that the road or pathway on which the toy vehicle is driving curves or leads toward the left.

Figure 9:
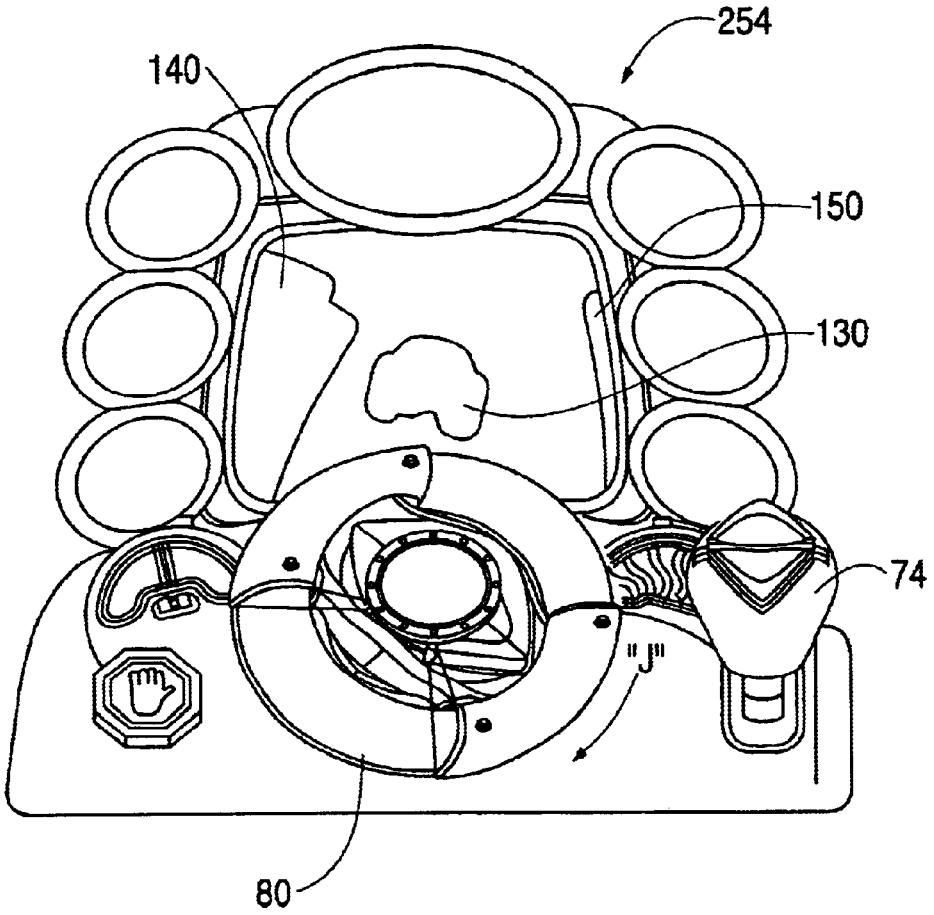
FIG. 9 illustrates the toy vehicle and boundary representations in a third configuration in accordance with the present invention.

In FIG. 9, the display elements 130, 140, and 150 are illustrated in a third configuration 254. In this configuration, the steering wheel 80 is rotated clockwise in the direction of arrow "J". As the steering wheel 80 is rotated, the display element 130 rotates to the right, thereby creating the appearance that the vehicle is turning to the right.

At the same time, display element 150 pivots to a position in which most of the display element 150 is not visible. Display element 140 also pivots to the right and the amount of the display element 140 visible in the display area increases. The movement of display elements 140 and 150 creates the appearance that the road or pathway on which the toy vehicle is driving curves or leads toward the right.

Figure 10:
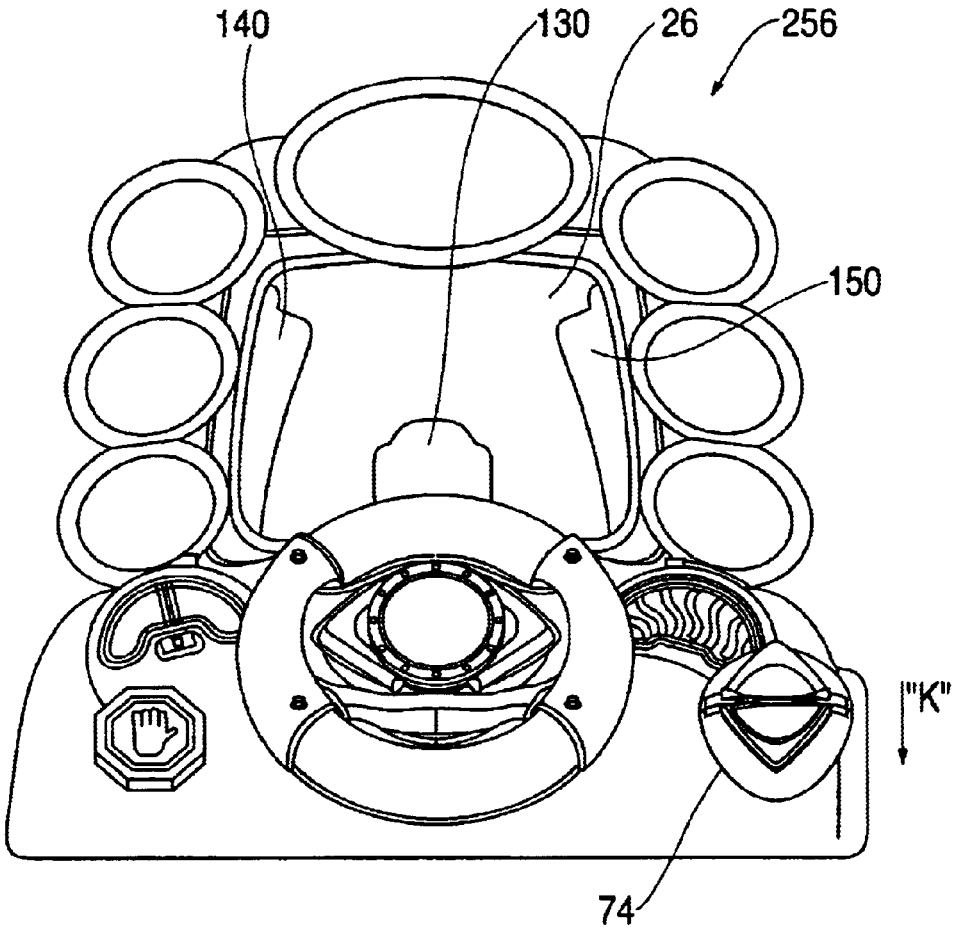
FIG. 10 illustrates the toy vehicle and boundary representations in a fourth configuration in accordance with the present invention.

In FIG. 10, the display elements 130, 140, and 150 are illustrated in a fourth configuration 256. In this configuration, the shifter knob 74 is moved downwardly in the direction of arrow "K". As the shifter knob 74 is moved downwardly, display element 130 moves downwardly relative to the other display elements 140 and 150 in the display area 26. Such movement of the display element 130 creates the appearance that the toy vehicle is slowing down.

Figure 11:
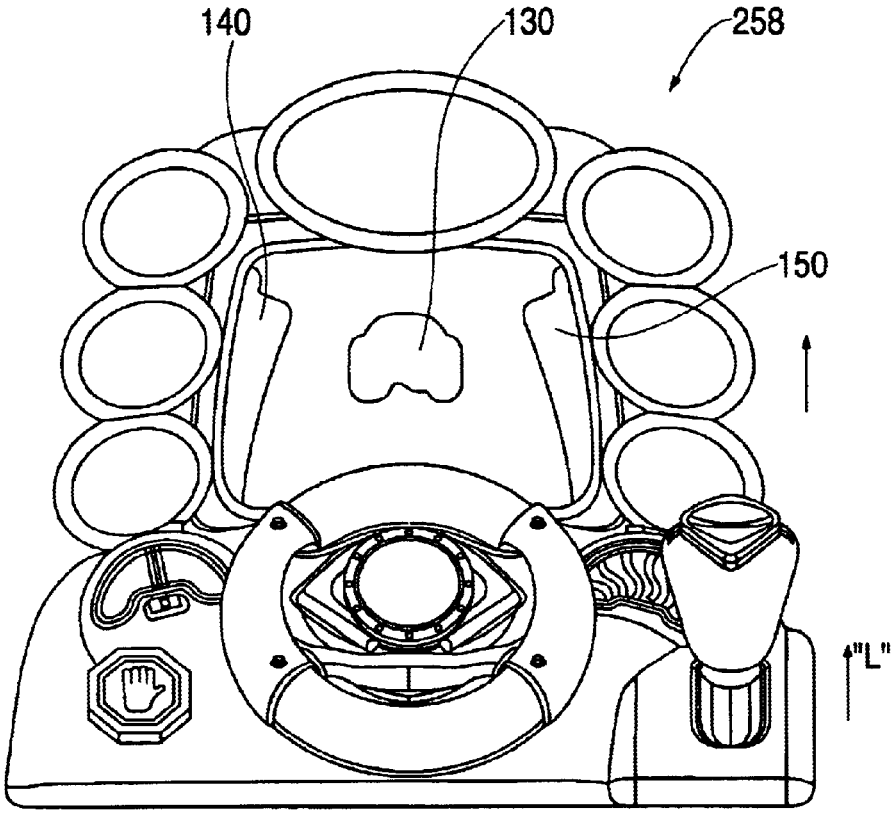
FIG. 11 illustrates the toy vehicle and boundary representations in a fifth configuration in accordance with the present invention.

In FIG. 11, the display elements 130, 140, and 150 are illustrated in a fifth configuration 258. In this configuration, the shifter knob 74 is moved upwardly in the direction of arrow "L". As the shifter knob 74 is moved upwardly, display element 130 moves upwardly relative to the other display elements 140 and 150 in the display area 26. Such movement of the display element 130 creates the appearance that the toy vehicle is accelerating.

A user can rotate the steering wheel 80 and move the shifting knob 74 simultaneously to move the display elements 130, 140, and 150 into a configuration that is a combination of those illustrated in FIGS. 7–11. For example, the user can rotate the steering wheel 80 to the right and move the shifter knob 74 upwardly to cause the toy vehicle to appear to accelerate and turn to the right.

In the illustrated embodiment, the toy driving mechanism 10 can include an output generating circuit. The output generating circuit can generate audio and visual outputs in response to user inputs and actions.

Figure 12:
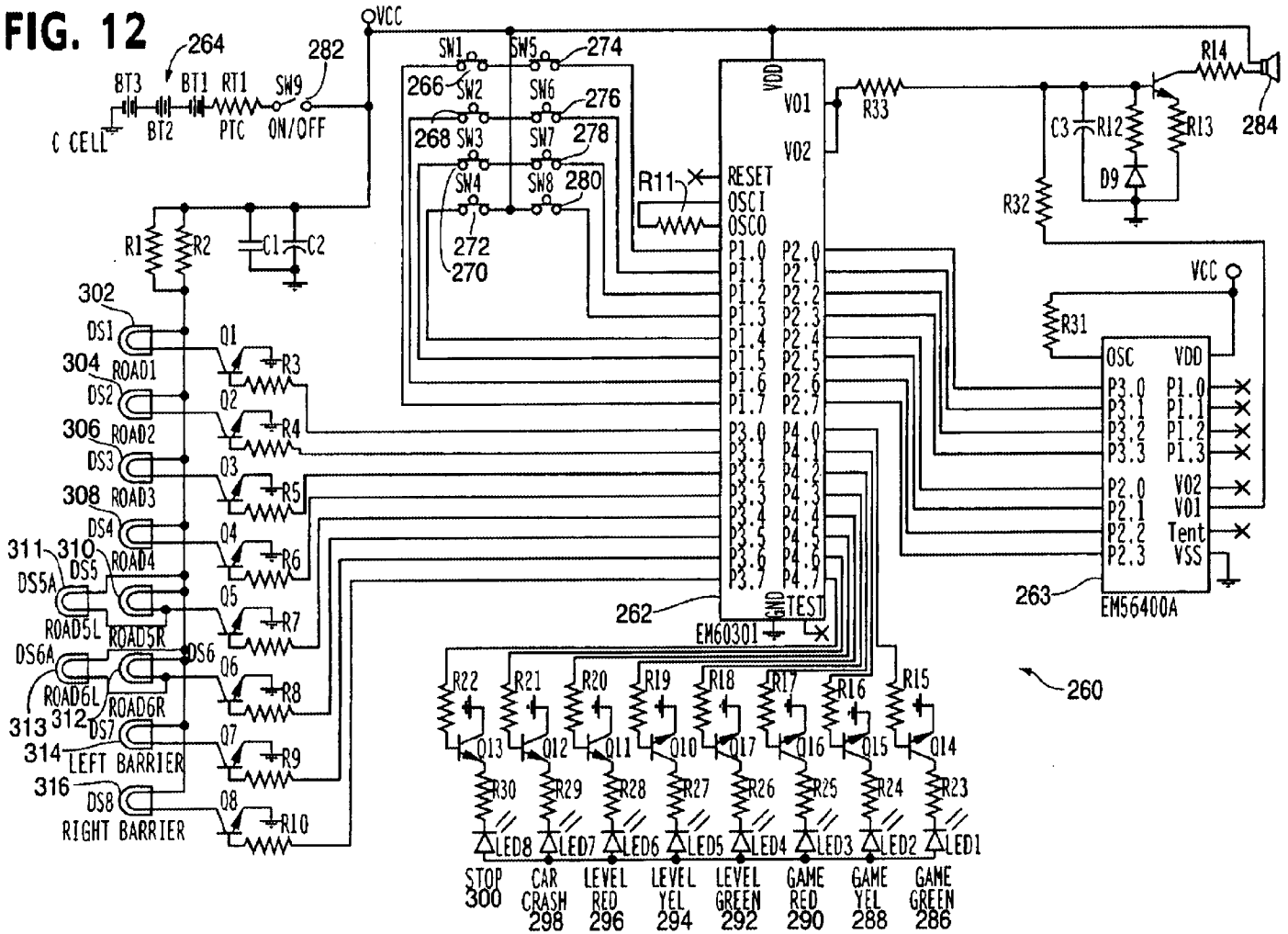
FIG. 12 illustrates an embodiment of an electronic system in accordance with the present invention.

An embodiment of an output generating circuit in accordance with the present invention is illustrated in FIG. 12. The electrical or output generating circuit 260 includes several inputs and several outputs.

As illustrated in FIG. 12, the output generating circuit 260 includes processors 262 and 263, a power switch 282, and a power supply 264. Each processor 262, 263 includes memory in which pre-recorded sound effects and/or speech segments are stored. The sound effects can include various vehicle related sounds, such as tire squeals, brake squeals, an engine revving, the shifting of an engine transmission, etc.

In the illustrated embodiment, the circuit 260 includes a stop switch 266 disposed beneath the stop button 62, a game switch 276 disposed beneath the game button 54, and a level switch 278 disposed beneath the level button 58. The use of the switches 266, 276, and 278 is discussed relative to the operation of the toy driving mechanism below.

The circuit 260 includes a horn switch 280 disposed proximate the horn 82. When a user presses the horn 82, the horn switch 280 closes and a sound resembling a car horn is played.

The output generating circuit 260 includes a forward switch 272 and a reverse switch 274. These switches 272 and 274 are located proximate to the shifting mechanism 122. For example, the switches 272 and 274 may be located proximate to the shaft 240 connected to the shifting knob 74.

When the user moves the shifter knob 74 upwardly a predetermined distance, the forward switch 272 is closed. Similarly, when the user moves the shifter knob 74 downwardly a predetermined distance, the reverse switch 274 is closed. When either of the forward switch 272 or the reverse switch 274 is closed, an audio output is generated.

The output generating circuit 260 includes a left switch 268 and a right switch 270. These switches 268 and 270 are located proximate to the steering mechanism 120. For example, the switches 268 and 270 may be located proximate to the shaft 84 connected to the steering wheel 80.

When the user moves the steering wheel 80 to the left a predetermined distance, the left switch 268 is closed. Similarly, when the user moves the steering wheel 80 to the right a predetermined distance, the right switch 270 is closed. When either of the left switch 268 or the right switch 270 is closed, an audio output is generated.

In the illustrated embodiment, the output generating circuit 260 includes several outputs. For example, the output generating circuit 260 includes an output transducer, such as a speaker, 284. The circuit 260 generates outputs that are generated via transducer 284.

The output generating circuit 260 includes several LEDs 286–300 that are illuminated in response to user inputs. The LEDs 286–300 are disposed beneath the covers 34, 36, 38, 46, 48, and 50.

In the illustrated embodiment, the output generating circuit 260 includes several lamps 302–312 that are inserted into openings 112 along the display plate 100. In one embodiment, the lamps 302–312 are disposed substantially in a column, with lamps 310 and 312 and lamps 311 and 313 being disposed along the slot 110 in the display plate 100. The lamps 302–312 are illuminated in a sequential manner, thereby creating the appearance that the toy vehicle is driving along a road. For example, the lamps 302–312 can be illuminated from top to bottom to create the appearance that the toy vehicle is driving forward. Alternatively, the lamps 302–312 can be illuminated from bottom to top to create the appearance that the toy vehicle is driving backward.

The output generating circuit 260 also includes a left barrier lamp 314 and a right barrier lamp 316. These lamps are disposed in the slots 101 and 103 on the display plate 100. The lamps 314 and 316 are illuminated during the operation of the toy driving mechanism.

During operation, the output generating circuit 260 generates various audio and visual outputs. For example, when the user rotates the steering wheel 80 to the left or the right and the corresponding left switch or right switch is closed, the output generating circuit 260 generates a tire squealing sound.

As the user moves the shifter knob 74 upwardly, the forward switch 272 is closed. When the forward switch is closed, the circuit 260 generates a tire peel out sound and a sound resembling the running of an engine changes to a sound resembling an engine revving quickly. Also, the pace at which the roadway lamps are illuminated from top to bottom along the display plate increases, thereby simulating the acceleration of the toy vehicle.

As the user moves the shifter knob 74 downwardly, the reverse switch 274 is closed. When the reverse switch is closed, the circuit 260 generates a sound resembling a downshift in the engine and a sound resembling an engine going backward. Also, the roadway lamps are illuminated from bottom to top along the display plate, thereby simulating the deceleration of the toy vehicle.

As the shifter knob 74 returns to its base position, the roadway lights either slow down or illuminate from bottom to top. Also, the engine sounds either slow down or speed up, whichever is appropriate.

As a user presses the stop button, the stop switch 266 closes and a tire squeal sound is generated. At the same time, the roadway lamps stop and flash.

The toy driving mechanism has two types of operation. The mechanism may be used in one of many game modes or in a free-play mode. In the free-play mode, the user can move the toy vehicle 130 by rotating the steering wheel 80 and/or moving the shifter knob 74.

Now the operation of the toy driving mechanism is described. When the toy driving mechanism is turned on, the user is prompted to select a game. If the user does not press any switch within a predetermined time period, such as eight seconds, then the output generating circuit 260 enters a power down mode.

In response to the prompt to select a game, the user can press the game button or the level button to change the particular game or level, respectively. If the user presses the game button, the last game played is announced. Successive depressions of the game button result in the scrolling through of the games. When the desired game is identified, the user stops pressing the game button. The user can select the particular level at which the game is played in a similar manner by pressing the level button. If the user presses any button other than the game button or the level button, then the toy driving mechanism enters a free-play mode.

The toy driving mechanism can be operated in several game modes. In one game mode, the object is to activate the directional switches a particular number of times within a predetermined time limit. In the illustrated embodiment, the directional switches include the left switch 268, the right switch 270, the forward switch 272, and the reverse switch 274. This game mode can be played at several different levels of difficulty. For example, at one level, the user may have to activate any three of the directional inputs or switches within a time limit. At another level, the user may have to activate any directional input five times in a time limit, such as five seconds.

In another game mode, the object is to complete a driving course within a time limit. The roadway barrier lights 314 and 316 indicating a barrier or obstruction are randomly illuminated. The user tries to "dodge" or drive around the barriers by rotating the steering wheel 80 to turn the toy vehicle 130 to avoid the barriers. When the shift lever 74 is pressed forwardly, the forward switch 272 is closed and the barriers flash more quickly, thereby reducing the reaction time for the user. The goal of this game is to complete the course in a predetermined time limit without hitting any barriers.

In another game mode, the output generating circuit randomly plays voice prompts either to go forward or to stop. The user has a predetermined time limit to go forward by moving the shift lever 74 forward to close the forward switch 272 or to stop by pressing the stop button to close the stop switch 266.

In another game mode, the output generating circuit randomly plays voice prompts to turn left, turn right, go forward, go backward, or stop. The user has a predetermined time limit to provide the appropriate input and close the appropriate switch.

In another game mode, the output generating circuit plays voice prompts as described in the previous game mode and provides visual prompts, such as the illumination of the left and right barricade lights. The user has a predetermined time limit to provide the appropriate input and to close the appropriate switch.

In another game mode, the output generating circuit prompts the user with multiple sets of commands. Each of the sets of commands includes two or more successive commands. For example, the prompts may include stop, left, right. The user has to close the appropriate switches in the correct order within a predetermined time period.

In one embodiment, at the end of a particular level, the processor determines whether any incorrect inputs were given. If none were done, then the output generating circuit plays various sound effects and illuminates various lights and the game advances to the next level. If some incorrect inputs were given, then the mechanism reverts to a free-play mode.

In one embodiment, the electrical circuit can maintain a high score. For example, the total time it takes to complete each level of a game can be stored.

Many alternatives are contemplated in accordance with the invention. In alternative embodiments, the display elements 140 and 150 can have any shape or configuration. The display elements 140 and 150 can include various indicia or representations disposed thereon. For example, the display elements 140 and 150 can be configured as walls, barriers, or other structures that define boundaries along a driving surface, thereby creating the image of a pathway. Alternatively, the display elements 140 and 150 may be shaped to represent particular structures.

Similarly, the display element 130 can be configured to represent any type of vehicle, such as a truck, spacecraft, or boat. The steering wheel 80 and the shifter knob 74 can be configured to represent any type of controllers.

In alternative embodiments, the display plate 100 may include indicia relating to any surface or medium for a vehicle. For example, the display plate can represent a road, a gravel surface, water, outer space, etc.

While the invention has been described in detail and with reference to specific embodiments thereof, it will be apparent to one skilled in the art that various changes and modifications may be made therein without departing from the spirit and scope thereof. Thus, it is intended that the present invention covers the modifications and variations of this invention provided they come within the scope of the appended claims and their equivalents.

What is claimed is:

1. A toy driving mechanism comprising:

a housing;

a first display portion coupled to said housing;

a controller coupled to said housing;

a second display portion operably coupled to said controller; and a third display portion operably coupled to said controller, at least a portion of at least one of the second display portion and the third display portion overlapping the first display portion, wherein movement of said controller causes substantially simultaneous movement of said second display portion and said third display portion relative to said first display portion.

2. The mechanism of claim 1, wherein said first display portion is fixedly coupled to said housing, said first display portion including an image disposed thereon.

3. The mechanism of claim 1, wherein said first display portion includes an image disposed thereon, said image includes a representation of a road, and said third display portion includes a representation of a boundary corresponding to said road.

4. The mechanism of claim 1, further comprising:

a fourth display portion, said third display portion being disposed proximate to a first side of said first display portion, said fourth display portion being disposed proximate to a second side of said first display portion.

5. The mechanism of claim 4, wherein said third display portion is mounted for movement about a first pivot point, said fourth display portion is mounted for movement about a second pivot point, and movement of said controller causes substantially simultaneous movement of said third display portion and said fourth display portion relative to said first display portion.

6. The mechanism of claim 1, wherein said second display portion resembles a toy vehicle, said second display portion is mounted for movement about a first pivot point, and said third display portion is mounted for movement about a second pivot point.

7. The mechanism of claim 1, the controller being a first controller, the mechanism further comprising:

a second controller coupled to said housing, said second controller being operably coupled to said second display portion, and movement of said second controller causes movement of said second display portion relative to said housing.

8. The mechanism of claim 7, wherein said second display portion is mounted for movement about a first pivot point, said third display portion is mounted for movement about a second pivot point, movement of said first controller causes substantially simultaneous movement of said second display portion about said first pivot point and said third display portion about said second pivot point, and movement of said second controller causes movement of said first pivot point relative to said housing.

9. The mechanism of claim 8, wherein said first controller includes a steering wheel and said second controller includes a shift lever.

10. A driving simulator mechanism comprising:

a housing, said housing having a plurality of walls defining therebetween an interior region, said housing including a display area;

a drive mechanism, said drive mechanism coupled to said housing;

a toy vehicle disposed in said interior region, said toy vehicle being operably coupled to said drive mechanism; and a first structure disposed in said interior region, said first structure being mounted for movement relative to said housing, said first structure being operably coupled to said drive mechanism, wherein said toy vehicle and said first structure move substantially simultaneously relative to said housing in response to movement of said drive mechanism.

11. The mechanism of claim 10, wherein said drive mechanism includes a steering wheel, and movement of said steering wheel causes substantially simultaneous movement of said toy vehicle and said first structure relative to said housing.

12. The mechanism of claim 10, further comprising:

a second structure disposed in said interior region, said second structure being operably coupled to said drive mechanism, said first structure resembling a boundary disposed on a first side of said display area, said second structure resembling a boundary disposed on a second side of said display area, and said first structure, said second structure, and said toy vehicle moving substantially simultaneously relative to said housing in response to movement of said drive mechanism.

13. A simulated driving environment comprising:

a housing, said housing including a display area;

a steering mechanism coupled to said housing;

a first representation disposed in said display area, said first representation being associated with a toy vehicle;

a second representation disposed in said display area, said second representation being associated with a driving surface, said first representation being disposed in front of said second representation; and a third representation disposed in said display area, said third representation being associated with said second representation, said third representation being disposed in front of said second representation, wherein said steering mechanism is coupled to said first representation and to said third representation, and movement of said steering mechanism causes movement of said first representation relative to said second representation and movement of said third representation relative to said second representation.

14. The simulated driving environment of claim 13, wherein said first representation and said third representation change their orientations relative to said second representation in response to movement of said steering mechanism.

15. The simulated driving environment of claim 13, further comprising;

a shifting mechanism coupled to said housing, said shifting mechanism being operatively coupled to said first representation, movement of said shifting mechanism causing movement of said first representation relative to said second representation.

16. A toy driving mechanism comprising:

a housing;

a first display portion coupled to the housing;

a controller coupled to the housing;

a second display portion operably coupled to the controller; and a third display portion operably coupled to the controller, the second display portion being disposed apart from the third display portion, wherein movement of the controller causes substantially simultaneous movement of the second display portion and the third display portion relative to the first display portion.

17. The mechanism of claim 16, wherein the first display portion is fixedly coupled to the housing, the first display portion including an image disposed thereon.

18. The mechanism of claim 16, wherein the second display portion is disposed laterally apart from the third display portion.

19. The mechanism of claim 16, further comprising:

a fourth display portion, the third display portion being disposed proximate to a first side of the first display portion, the fourth display portion being disposed proximate to a second side of the first display portion.

20. The mechanism of claim 19, wherein the third display portion is mounted for movement about a first pivot point, the fourth display portion is mounted for movement about a second pivot point, and movement of the controller causes substantially simultaneous movement of the third display portion and the fourth display portion relative to the first display portion.

21. The mechanism of claim 16, wherein the second display portion resembles a toy vehicle, the second display portion is mounted for movement about a first pivot point, and the third display portion is mounted for movement about a second pivot point.

22. The mechanism of claim 16, the controller being a first controller, further comprising:

a second controller coupled to the housing, the second controller being operably coupled to the second display portion, and movement of the second controller causes movement of the second display portion relative to the housing.

23. The mechanism of claim 22, wherein the second display portion is mounted for movement about a first pivot point, the third display portion is mounted for movement about a second pivot point, movement of the first controller causes substantially simultaneous movement of the second display portion about the first pivot point and the third display portion about the second pivot point, and movement of the second controller causes movement of the first pivot point relative to the housing.

24. The mechanism of claim 23, wherein the first controller includes a steering wheel and the second controller includes a shift lever.

25. A toy driving mechanism comprising:

a housing having a screen;

a first display portion coupled to the housing;

a controller coupled to the housing;

a second display portion operably coupled to the controller; and a third display portion operably coupled to the controller, at least a portion of at least one of the second display portion and the third display portion being disposed between the screen of the housing and the first display portion, wherein movement of the controller causes substantially simultaneous movement of the second display portion and the third display portion relative to the first display portion.

26. The mechanism of claim 25, wherein said first display portion is fixedly coupled to said housing, said first display portion including an image disposed thereon.

27. The mechanism of claim 25, wherein said first display portion includes an image disposed thereon, said image includes a representation of a road, and said third display portion includes a representation of a boundary corresponding to said road.

28. The mechanism of claim 25, further comprising:

a fourth display portion, said third display portion being disposed proximate to a first side of said first display portion, said fourth display portion being disposed proximate to a second side of said first display portion.

29. The mechanism of claim 28, wherein said third display portion is mounted for movement about a first pivot point, said fourth display portion is mounted for movement about a second pivot point, and movement of said controller causes substantially simultaneous movement of said third display portion and said fourth display portion relative to said first display portion.

30. The mechanism of claim 25, wherein said second display portion resembles a toy vehicle, said second display portion is mounted for movement about a first pivot point, and said third display portion is mounted for movement about a second pivot point.

31. The mechanism of claim 25, the controller being a first controller, the mechanism further comprising:

a second controller coupled to said housing, said second controller being operably coupled to said second display portion, and movement of said second controller causes movement of said second display portion relative to said housing.

32. The mechanism of claim 31, wherein said second display portion is mounted for movement about a first pivot point, said third display portion is mounted for movement about a second pivot point, movement of said first controller causes substantially simultaneous movement of said second display portion about said first pivot point and said third display portion about said second pivot point, and movement of said second controller causes movement of said first pivot point relative to said housing.

33. The mechanism of claim 32, wherein said first controller includes a steering wheel and said second controller includes a shift lever.

* * * * *